US007075006B2

(12) United States Patent
Nojima et al.

(10) Patent No.: US 7,075,006 B2
(45) Date of Patent: Jul. 11, 2006

(54) ELECTRICAL JUNCTION BOX

(75) Inventors: Shigeru Nojima, Yokkaichi (JP); Manabu Matsumoto, Okazaki (JP); Mitsuhiro Kato, Nishikamo-gun (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/913,449

(22) Filed: Aug. 9, 2004

(65) Prior Publication Data

US 2005/0079740 A1 Apr. 14, 2005

(30) Foreign Application Priority Data

Aug. 8, 2003 (JP) ..... 2003-290270

(51) Int. Cl.
*H01H 13/04* (2006.01)

(52) U.S. Cl. ..... 174/58; 174/50; 174/53; 174/52.1; 174/61; 220/3.2; 220/3.3; 220/3.8; 220/3.9; 220/4.02

(58) Field of Classification Search ..... 174/58, 174/50, 52.1, 53, 61; 220/3.2, 3.3, 3.8, 3.9, 220/4.02

See application file for complete search history.

(56) References Cited

U.S. PATENT DOCUMENTS 6,515,226 B1 * 2/2003 Chiriku et al. ..... 174/50
6,570,088 B1 * 5/2003 Depp et al. ..... 174/50

FOREIGN PATENT DOCUMENTS

JP A 2002-315141 10/2002

* cited by examiner

*Primary Examiner*—Dean A. Reichard
*Assistant Examiner*—Anton Harris
(74) *Attorney, Agent, or Firm*—Oliff & Berridge, PLC

(57) ABSTRACT

In an electrical junction box for an automobile vehicle, a casing includes upper and lower casing members. A lock section joints the upper and lower casing members. A vehicle attachment section extends outward from an outer surface of the casing above the lock section. A bracket projecting from a vehicle body is inserted upward into the vehicle attachment section to fix the electrical junction box onto the vehicle body. The electrical junction box comprises a lock protection section including right and left ribs that project from the outer surface of the casing on the opposite sides of the lock section so that the right and left ribs extend to a position higher than the lock section. A distance between the right and left ribs is set to be smaller than a width of the bracket. Then, interference between the bracket and the lock section is prevented upon insertion of the bracket to prevent a casing lock section of an electrical junction box from being damaged when the electrical junction box is secured to a vehicle body.

2 Claims, 6 Drawing Sheets

ELECTRICAL JUNCTION BOX

CLAIM FOR PRIORITY

This invention relates to subject-matter contained in and claims priority to JP 2003-290270, filed on Aug. 8, 2003, the entire disclosure of which is incorporated herein by reference thereto.

BACKGROUND OF THE INVENTION

1. Field of Invention

This invention relates to an electrical junction box for an automobile vehicle and more particularly relates to an electrical junction box that is secured to a vehicle body of an automobile vehicle by inserting a bracket projecting from the vehicle body into a section being attached to the vehicle body that projects from the electrical junction box, thereby preventing interference between the bracket and a lock section for upper and lower casing members of the electrical junction box upon insertion of the bracket.

2. Description of Related Art

Generally, in order to secure an electrical junction box to a vehicle body of an automobile vehicle, a bolt welded on the vehicle body is inserted into a bolt hole formed in a bracket that extends outward from a casing of the electrical junction box and then the bolt is fastened onto the bracket by a nut (see Japanese Patent Public Disclosure 2002-315141).

However, there is a case where a bracket cannot be projected from an electrical junction box on account of a configuration or an arrangement space of the electrical junction box. For example, as shown in FIG. 7, in an electrical junction box in which a lower cover 2 is jointed and locked on a casing body 1, a section 1*a* being attached to a vehicle body 5 (or a vehicle attachment section 1*a*) extends from an outer surface of the casing body 1, a latch piece 1*c* is provided on the interior of an outer frame 1*b* of the vehicle attachment section 1*a*. A bracket 6 that projects from the vehicle body 5 is inserted upward into the outer frame 1*b* of the vehicle attachment section 1*a* and an engaging pawl 1*d* formed on an upper end of the latch piece 1*c* is fitted into an engaging opening 6*a* formed in the bracket 6.

In the electrical junction box, the casing body 1 is provided on the lower end with a casing lock portion including a lock pawl 1*e*. The lower cover 2 is provided on the upper end with a casing-locked portion including a lock frame 2*a* to be engaged with the lock pawl 1*e*. The casing body 1 and the lower cover 2 are coupled to and locked on each other.

The vehicle attachment section 1*a* having the latch piece 1*c* is disposed immediately above the lock pawl 1*e* of the casing body 1. This structure is determined by an arrangement in a drawing direction of upper and lower molds when molding the casing body 1 by a resin material.

A lock section R in which the lock pawl 1*e* is jointed to the lock frame 2*a* must be disposed immediately below the vehicle attachment section 1*a* due to the above arrangement. The bracket 6 of the vehicle body is inserted into the vehicle attachment section 1*a* along the lock section R when securing the electrical junction box to the vehicle body. This results in interference between the lock section R and the bracket 6. At this time, there is a problem in which an upper end of the metallic bracket 6 may damage the lock frame 2*a* or the lock pawl 1*e*.

SUMMARY OF THE INVENTION

In view of the above problems, an object of the invention is to prevent interference between a bracket on a vehicle body and a lock section of a casing of an electrical junction box, when the bracket is inserted upward into a vehicle attachment section of the electrical junction box.

In order to achieve the above object, the invention provides an electrical junction box for an automobile vehicle wherein a casing includes upper and lower casing members, a lock section joints the upper and lower casing members, a vehicle attachment section extends outward from an outer surface of the casing above the lock section, and a bracket projecting from a vehicle body is inserted upward into the vehicle attachment section to fix the electrical junction box onto the vehicle body. The electrical junction box comprises a lock protection section including right and left ribs that project from the outer surface of the casing on at least opposite sides of the lock section so that the right and left ribs extend to a position higher than the lock section. A distance between the right and left ribs is set to be smaller than a width of the bracket. Then, interference between the bracket and the lock section is prevented upon insertion of the bracket.

Because the right and left ribs project from the outer surface of the casing on the opposite sides of the lock section so that the right and left ribs extend to a position higher than the lock section and the distance between the right and left ribs is narrower than the width of the bracket, the bracket cannot be inserted upward through the space between the right and left ribs into the vehicle attachment section. Accordingly, it is possible to surely prevent the bracket from contacting with the lock section and damaging the lock section.

More particularly, the electrical junction box comprises a relay box. The upper casing member is a casing body while the lower casing member is a lower cover. The lock section includes a casing lock portion provided on a lower end of the casing body and a casing locked portion provided on an upper end of the lower cover. The vehicle attachment section is provided on the casing body. A latch piece is provided on the interior of an outer frame of the vehicle attachment section. The bracket projects from the vehicle body and has a substantially U-shape in cross section. The latch piece is fitted into an engaging opening formed in the bracket when the bracket is inserted into the interior of the outer frame of the vehicle attachment section. The lock protection section is formed into a substantially U-shape to enclose the casing locked portion. The lock protection section includes right and left ribs and a front jointing portion for coupling front ends of the right and left ribs to each other or a lower end jointing portion for coupling lower ends of the right and left ribs to each other. The bracket having the U-shape in cross section is inserted into the vehicle attachment section while the opposite sidewalls of the bracket slide along the outer surfaces of the right and left ribs.

According to the above structure, even if the electrical junction box is slightly inclined with respect to the bracket when attaching the electrical junction box to the vehicle body, the bracket is not inserted into a space between the right and left ribs, thereby positively preventing the bracket from contacting with the lock section.

Because the bracket can be guided along the outer surfaces of the right and left ribs to be inserted into the vehicle attachment section, it is possible to align the engaging opening in the bracket with the lock pawl, thereby smoothly carrying out locking between the vehicle body and the electrical junction box. Furthermore, if the outer surfaces of the right and left ribs hold the opposite sidewalls of the bracket with the outer surfaces contacting with the opposite sidewalls after coupling, it is possible to prevent the bracket from rattling and thus to secure the electrical junction box to the vehicle boy without causing the rattling.

It will be apparent from the foregoing that because the electrical junction box is secured to the vehicle body by a simple structure in which the right and left ribs are provided on the opposite sides of the lock section of the electrical junction box, it is possible to prevent interference between the bracket and the lock section disposed below the vehicle attachment section of the electrical junction box when the bracket is inserted upward into the vehicle attachment section. Accordingly, the bracket will not damage the lock section on account of contact.

DETAILED DESCRIPTION OF EXEMPLARY EMBODIMENTS

Figure 1:
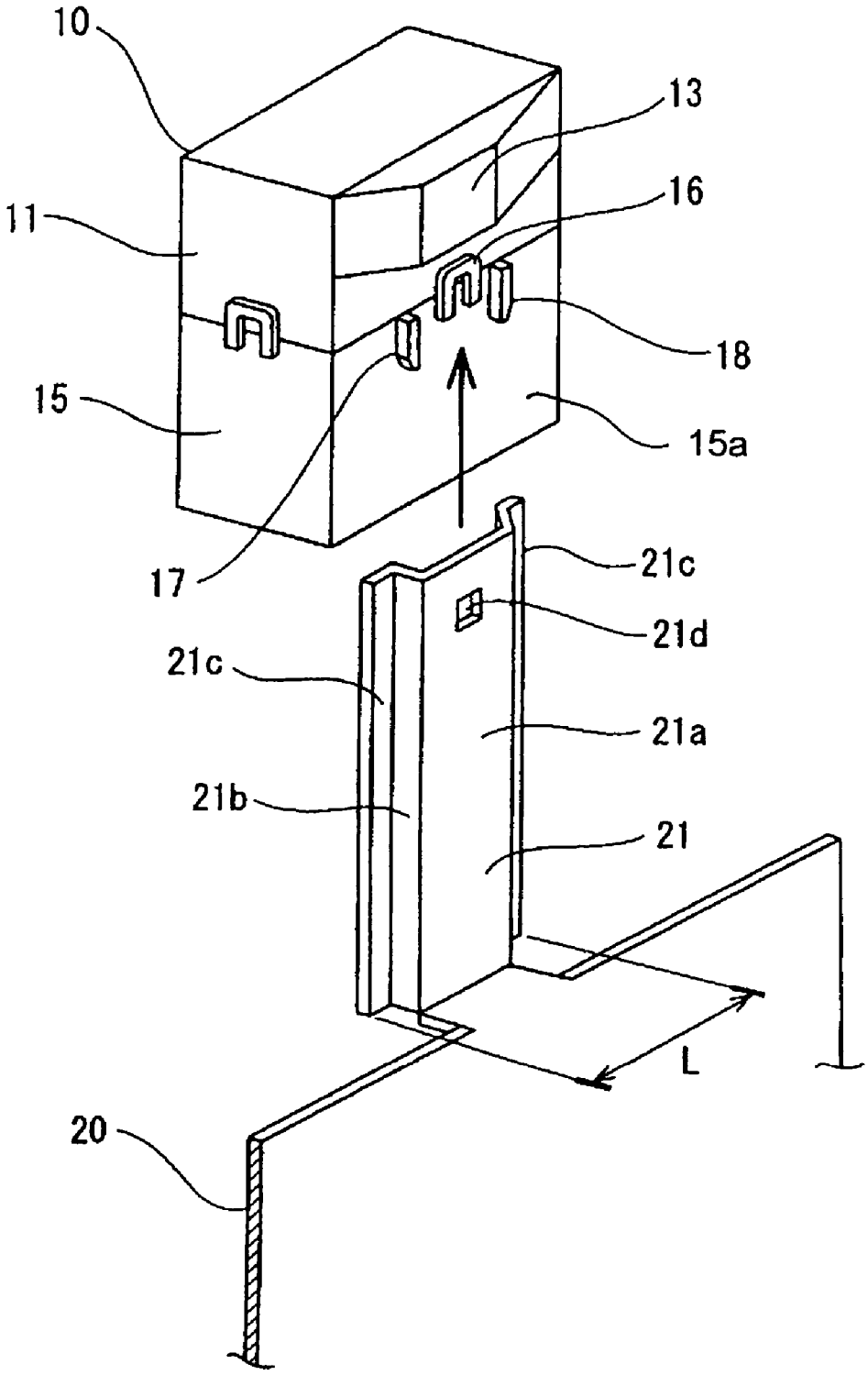
FIG. 1 is a perspective view of an embodiment of a relay box in accordance with the invention, illustrating a relationship between the relay box and a vehicle body.
Figure 2:
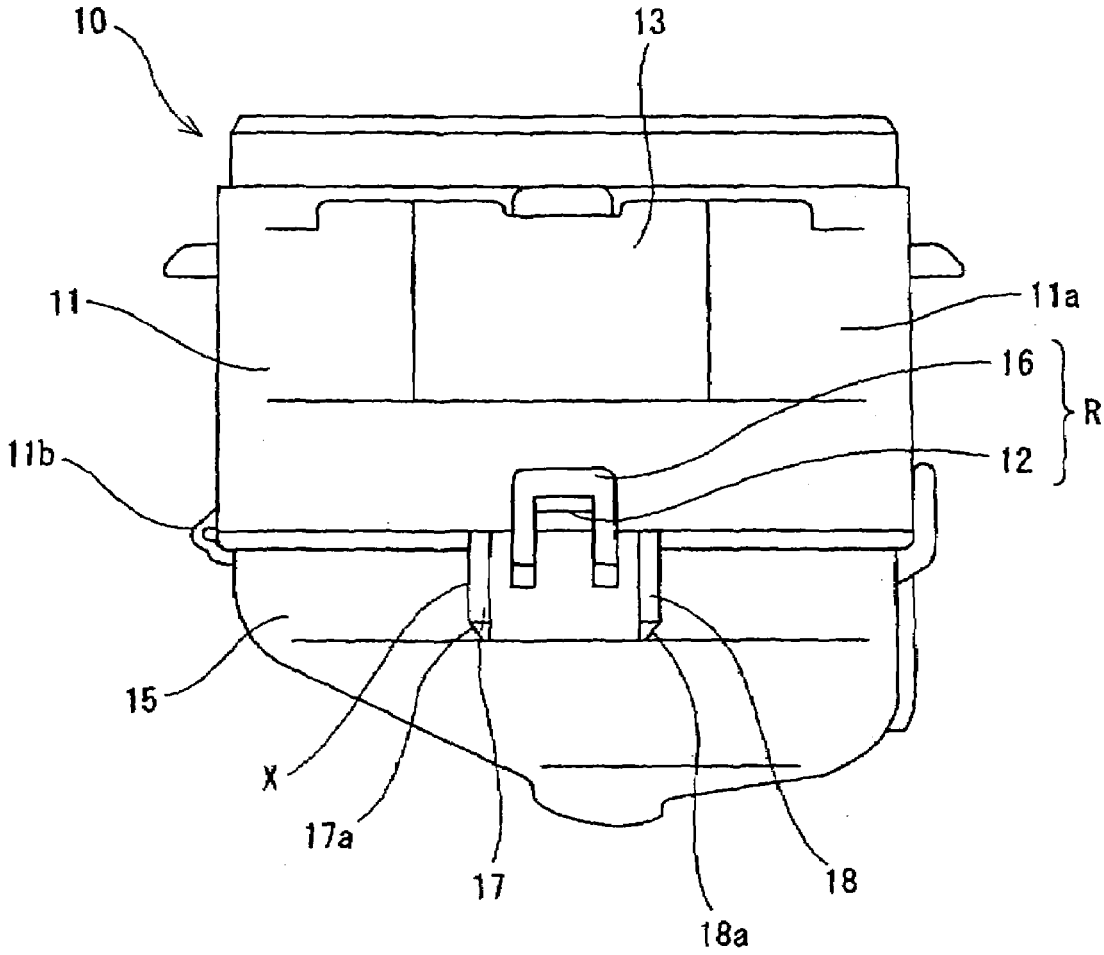
FIG. 2 is a front elevation view of the relay box shown in FIG. 1.
Figure 3A:
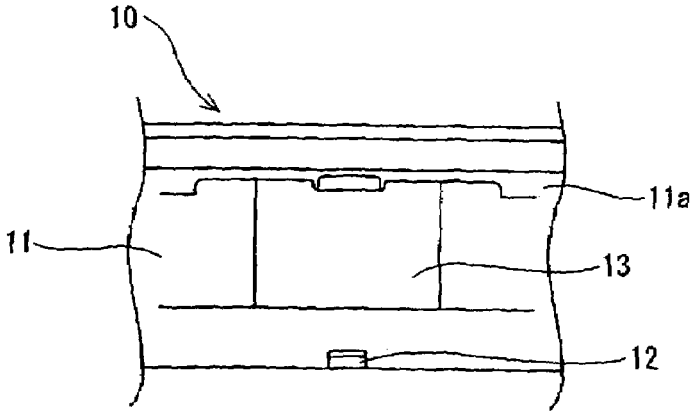
FIG. 3A is a front elevation view of a main part of a casing body in the relay box.
Figure 3B:
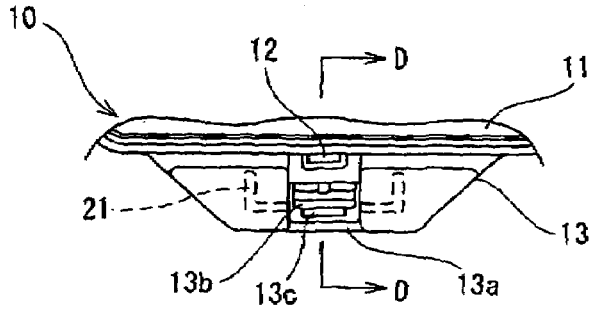
FIG. 3B is a plan view of FIG. 3A.
Figure 3C:
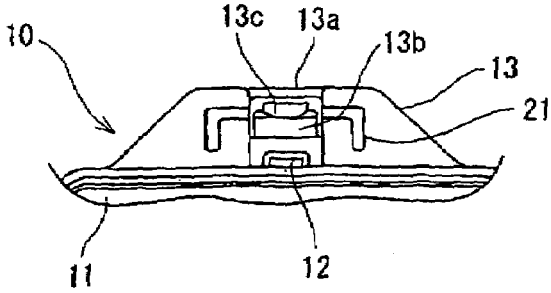
FIG. 3C is a bottom view of FIG. 3A.
Figure 3D:
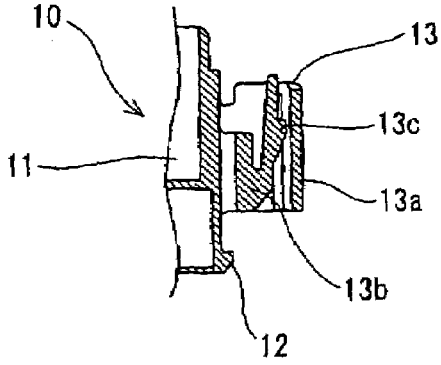
FIG. 3D is a cross section view of the casing body taken along lines D—D in FIG. 3B.
Figure 4:
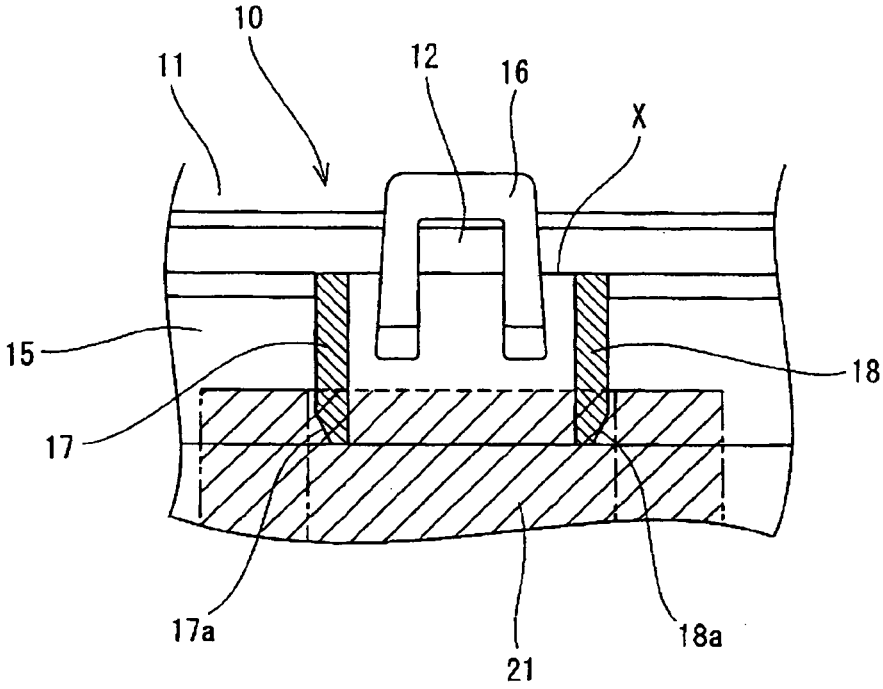
FIG. 4 is an enlarged front elevation view of a main part of the relay box, illustrating a relationship between a bracket and a lock section for coupling the casing body and a lower cover to each other.
Figure 5:
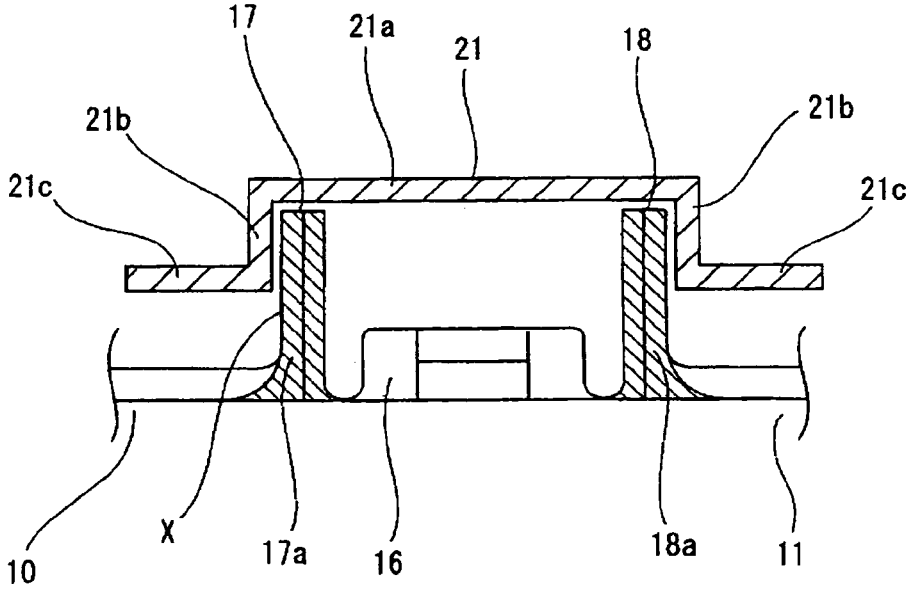
FIG. 5 is a sectional view of FIG. 4.

Referring now to the drawings, embodiments of an electrical junction box in accordance with the invention will be described below.

FIGS. 1 to 5 show an embodiment of the invention. A relay box 10 to be mounted on an automobile vehicle includes a casing comprising a casing body 11 and a lower cover 15 that are made of a resin material, respectively. The casing body 11 and lower cover 15 are jointed and locked to each other. The relay box 10 is secured to a vehicle body 20 through a metallic bracket 21 projecting from the vehicle body 20.

The casing body 11 is formed into a substantially rectangular configuration and is provided on a front wall 11*a* (see FIG. 1) at the central lower part with a lock pawl 12. Another lock pawl 11*b* is provided on a sidewall of the casing body 11 (see FIG. 2) at the lower end. A section 13 being attached to the vehicle body 20 (or vehicle attachment section 13) is provided on the front wall 11*a* above the lock pawl 12. The vehicle attachment section 13 includes an outer frame 13*a* (see FIG. 3D) that is open at the upper and lower ends and a deflectable latch piece 13*b* provided on the interior of the outer frame 13*a* and having a J-shape in cross section. The latch piece 13*b* is provided on the outer surface with an engaging pawl 13*c* (see FIG. 3D). Thus, the lock pawl 12 is disposed immediately below the latch piece 13*b*.

A lock frame 16 extends upward from a front wall 15*a* (see FIG. 1) of the lower cover 15 at the central upper end for engagement with the lock pawl 12. Right and left ribs 17 and 18 are provided on the opposite sides of the lock frame 16 on the lower cover 15 to form a lock protection section X. The right and left ribs 17 and 18 have projection heights greater than that of the lock pawl 12. A distance between the right and left ribs 17 and 18 is set to be smaller than a width L (see FIG. 1) of the bracket 21. The respective right and left ribs 17 and 18 are provided on the respective lower ends with tapered surfaces 17*a* and 18*a* that are inclined inward (see FIG. 2).

Figure 7:
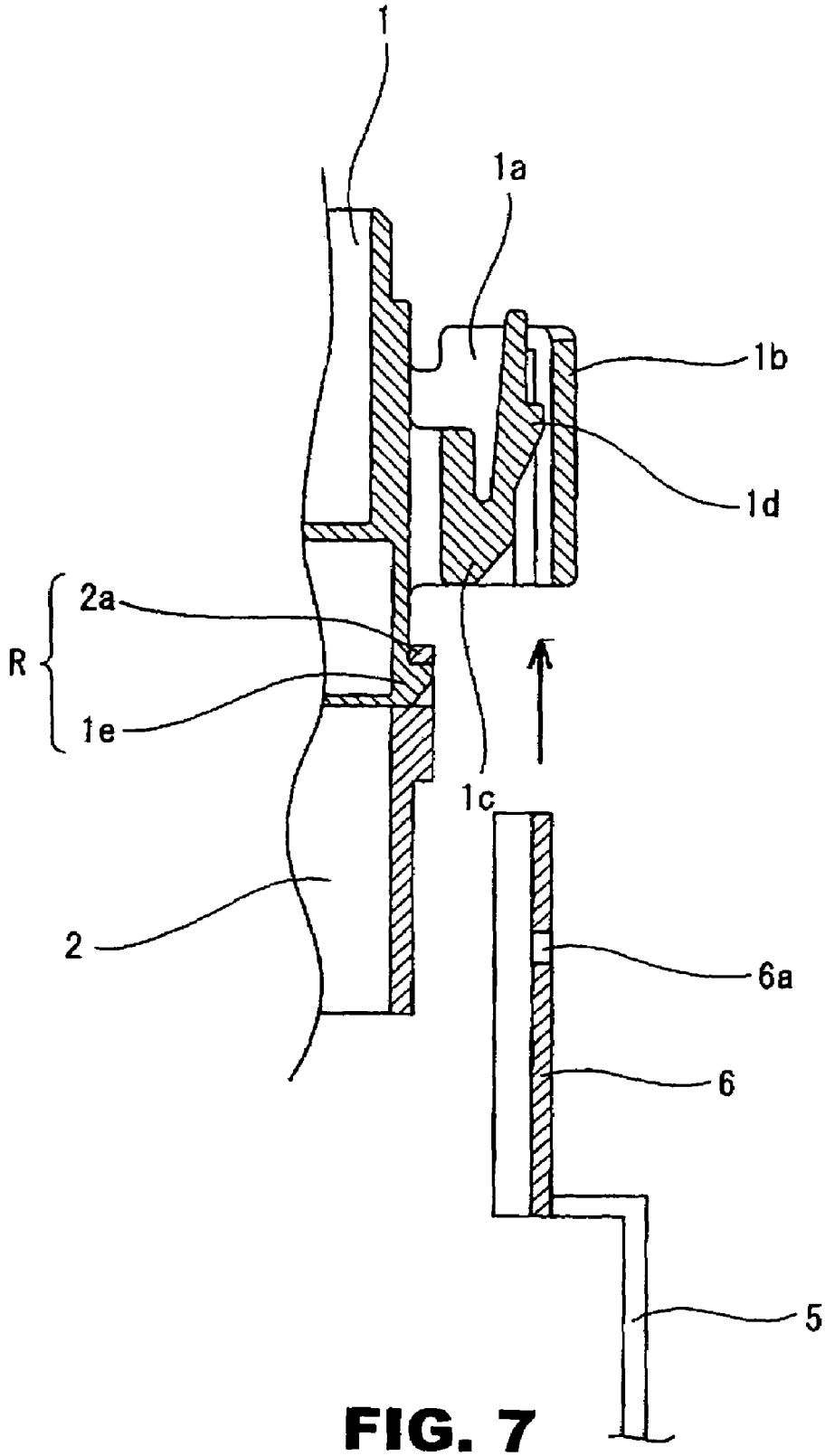
FIG. 7 (Related Art)
FIG. 7 is a cross section view of a conventional relay box.

The bracket 21 that extends from the vehicle body 20 has the same configuration as that of a conventional bracket shown in FIG. 7. As shown in FIG. 1, the bracket 21 includes a flat plate 21*a* and sidewalls 21*b* bent from the opposite sidewalls of the flat plate 21*a* to be formed into a U-shape in cross section. Outward extensions 21*c* are provided on the distal sidewalls of the sidewalls 21*b*. The flat plate 21*a* is provided in the upper central portion with an engaging opening 21*d*.

The relay box 10 is secured to the vehicle body 20 when the bracket 21 is inserted upward into the outer frame 13*a* of the vehicle attachment section 13 on the casing body 11 and the engaging pawl 13*c* is fitted in the engaging opening 21*d*.

When the bracket 21 is inserted upward into the vehicle attachment section 13 in order to secure the relay box 10 to the vehicle body 20, the opposite sidewalls 21*b* of the bracket 21 are inserted into the outer frame 13*a* of the vehicle attachment section 13 along the outer surfaces of the right and left ribs 17 and 18 of the lock protection section X. At this time, because the right and left ribs 17 and 18 have tapered surfaces 17*a* and 18*a* on their lower ends, it is easy to position the opposite sidewalls 21*b* of the bracket 21 on the outer surfaces of the right and left ribs 17 and 18.

When the bracket 21 is inserted upward into the outer frame 13*a* of the vehicle attachment section 13, the outward extensions 21*c* slide on the outer surface of the front wall 11*a* of the casing body 11, the flat plate 21*a* moves upward along the outer surface of the latch piece 13*b*, and the engaging pawl 13*c* is fitted into the engaging opening 21*d*, thereby fixing the relay box 10 on the vehicle body 20.

As described above, because the opposite sidewalls 21*b* of the bracket 21 move along the right and left ribs 17 and 18 when the bracket 21 is inserted upward into the vehicle attachment section 13, it is possible to surely prevent the bracket 21 from contacting with a lock section R (see FIG. 2) in which the lock pawl 12 engages the lock frame 16. Consequently, the metallic bracket 21 will not damage the lock pawl 12 and lock frame 16 that are made of a resin material.

Figure 6A:
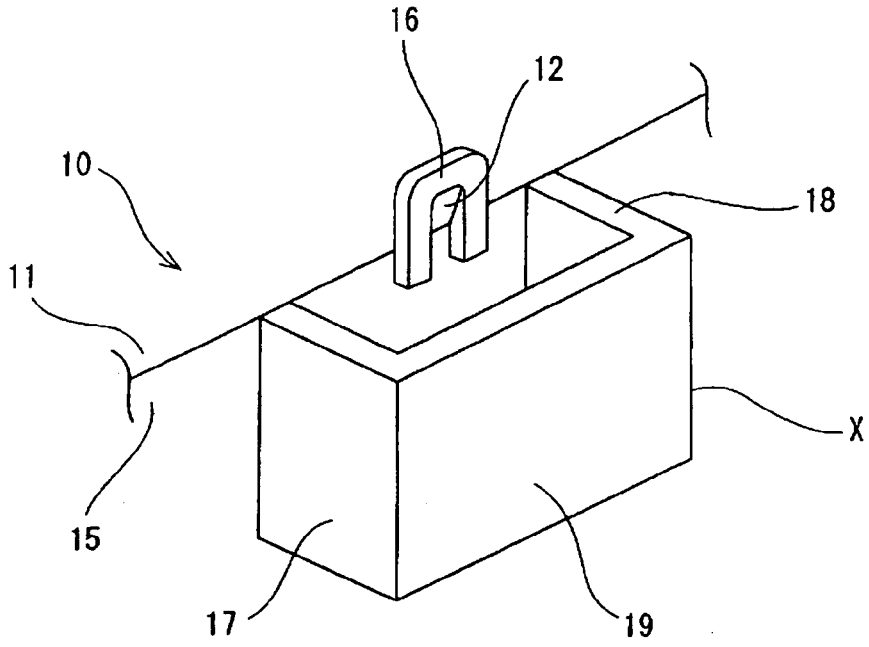
FIG. 6A is a perspective view of an alteration of a lock protection section.
Figure 6B:
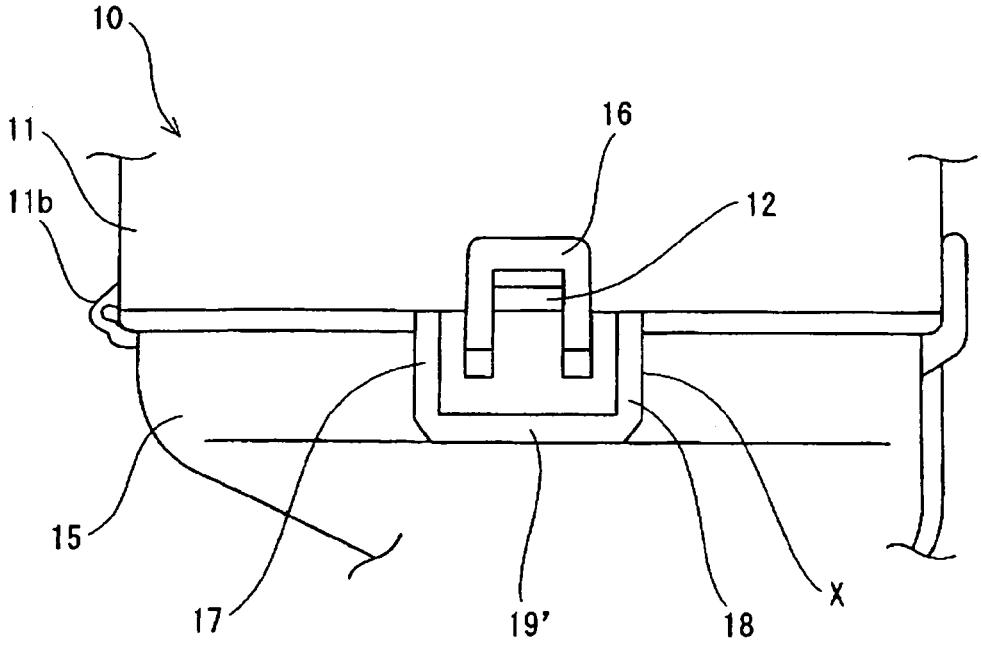
FIG. 6B is a front elevation view of another alteration of the lock protection section.

It will be understood by a person skilled in the art that the invention is not limited to the above embodiment. For example, as shown in FIG. 6A, projection ends of the right and left ribs 17 and 18 are coupled to each other at a front side 19 to form a lock protection section X having a U-shape in cross section taken from a horizontal direction. Further, as shown in FIG. 6B, the right and left ribs 17 and 18 are coupled to each other at lower end portions 19' to form a U-shape in cross section taken from a front side.

The above configurations can surely prevent the bracket from contacting the lock pawl and lock frame by means of the lock protection section X.

Although the invention has been described with reference to particular means, materials and exemplary embodiments, it is to be understood that the invention is not limited to the particulars disclosed and extends to all equivalents within the scope of the claims. It is evident that many alternatives, modifications, and variations will be apparent to those skilled in the art in light of the foregoing description. It is therefore contemplated that the appended claims will embrace any such alternatives, modifications, and variations as falling within the true scope and spirit of the invention.

What is claimed is:

1. An electrical junction box for an automotive vehicle including a bracket projecting from a vehicle body, the electrical junction box comprising:

a casing having upper and lower casing members;

a lock section joining the upper and lower casing members;

a vehicle attachment section extending outward from an outer surface of the casing above the lock section, wherein the bracket is inserted upward into the vehicle attachment section to fix the electrical junction box onto the vehicle body; and a lock protection section including right and left ribs that project from the outer surface of the casing on at least opposite sides of the lock section so that the right and left ribs extend to a position higher than the lock section, wherein a distance between the right and left ribs is smaller than a width of the bracket, and whereby interference between the bracket and the lock section is prevented upon insertion of the bracket.

2. The electrical junction box according to claim 1, wherein the upper casing member is a casing body and the lower casing member is a lower cover, the lock section includes a casing lock portion provided on a lower end of the casing body and a casing locked portion provided on an upper end of the lower cover, the vehicle attachment section is provided on the casing body, a latch piece is provided on the interior of an outer frame of the vehicle attachment section, the bracket projects from the vehicle body and has a substantially U-shape in cross section, the latch piece is fitted into an engaging opening formed in the bracket when the bracket is inserted into the interior of the outer frame of the vehicle attachment section, the lock protection section is formed into a substantially U-shape to enclose the casing locked portion, the lock protection section includes right and left ribs and a front jointing portion for coupling front ends of the right and left ribs to each other or a lower end jointing portion for coupling lower ends of the right and left ribs to each other, and the bracket having the U-shape in cross section is inserted into the vehicle attachment section while the opposite sidewalls of the bracket slide along the outer surfaces of the right and left ribs.

* * * * *